US006503090B2

(12) United States Patent
Onizuka

(10) Patent No.: US 6,503,090 B2
(45) Date of Patent: Jan. 7, 2003

(54) CIRCUIT BOARD CONNECTING STRUCTURE AND METHOD OF CONNECTING THE CIRCUIT BOARD

(75) Inventor: Takahiro Onizuka, Nagoya (JP)

(73) Assignees: Autonetworks Technologies, Ltd., Nagoya (JP); Sumitomo Wiring Systems Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/838,150

(22) Filed: Apr. 20, 2001

(65) Prior Publication Data

US 2002/0004335 A1 Jan. 10, 2002

(30) Foreign Application Priority Data

Jun. 28, 2000 (JP) ..... 2000-193900

(51) Int. Cl.[7] ..... H01R 9/09
(52) U.S. Cl. ..... 439/75; 439/949; 439/751
(58) Field of Search ..... 439/590, 736, 439/76.2, 949, 751

(56) References Cited

U.S. PATENT DOCUMENTS 3,372,308 A * 3/1968 Noschese et al. ..... 439/82
3,378,808 A * 4/1968 Friench ..... 439/590
5,567,167 A * 10/1996 Hayashi ..... 439/75

FOREIGN PATENT DOCUMENTS

| | | |
|---|---|---|
| EP | 0 939 453 A2 | 9/1999 |
| JP | 10189085 | 7/1998 |
| JP | 2000022353 | 1/2000 |
| JP | 2000-022353 | 1/2000 |

* cited by examiner

*Primary Examiner*—Neil Abrams
*Assistant Examiner*—Phuong Dinh
(74) *Attorney, Agent, or Firm*—Oliff & Berridge PLC

(57) ABSTRACT

A plurality of board connecting terminals each having a board connecting portion and a pressed-in portion are fixed to an insulating connecting element and thus integrally formed as a circuit board connecting terminal assembly. The board connecting portion of each of the terminals is inserted into a corresponding one of through holes formed in the printed circuit board in such a manner as to penetrate therethrough. Thus, the board connecting portion of each of the terminals is electrically connected thereto, so that the printed circuit board with the board connecting terminals are constituted. Then, a pressed-in portion of each of the circuit connecting terminals is press-fitted into a corresponding press-fitting hole and electrically connected to a corresponding one of the bus bars.

16 Claims, 10 Drawing Sheets

CIRCUIT BOARD CONNECTING STRUCTURE AND METHOD OF CONNECTING THE CIRCUIT BOARD

BACKGROUND OF THE INVENTION

1. Field of the Invention

The present invention relates to a structure and method for electrically connecting a plurality of bus bars of an electric circuit to a printed circuit board, on which a control circuit is mounted, in an electric connection box mounted on a vehicle.

2. Description of the Related Art

Generally, in a junction box to be mounted on a vehicle, an electric circuit is constituted by many bus bars formed by being punched out from metallic plates. Further, in recent years, there has been provided a junction box having a printed circuit board on which a control circuit is mounted so as to add advanced control functions to the electric circuit. In the case of such circuits, there is the necessity for electrically connecting the bus bars to the printed circuit board. For example, JP-A-2000-22353 Official Gazette discloses tab terminals, which are formed by bending end portions of the bus bars in such a way as to extend upright and inserted into through holes provided in the printed circuit board and electrically connected to the circuit mounted on the substrate by soldering, as means therefor.

FIGS. 11 and 12 illustrate a practical structure thereof. A bus bar board 2 illustrated in FIG. 11 comprises a plurality of insulating plates 3, and bus bar layers each consisting of a plurality of bus bars 4. In this board, the plurality of insulating plates 3, and the bus bar layers are alternately stacked. End portions of appropriate ones of the bus bars 4 are turned upwardly, as illustrated in FIG. 12. Thus, tab terminals 4*a* projecting upwardly are formed.

On the other hand, predetermined electronic circuit components 5*a* are mounted on a printed circuit board 5. Further, a plurality of through holes 5*b* are provided in the printed circuit board 5. Inner surfaces of these through holes 5*b* are plated with a metallic material. The plated portions thereof are electrically connected to a printed circuit. Moreover, each of the tab terminals 4*a* is inserted into a corresponding one of the through holes 5*b* and soldered to the circuit. Thus, the terminals 4*a* corresponding to the end portions are electrically connected to a control circuit provided on the printed circuit board 5 through the portions plated with the metallic material.

A connecting structure, in which the tab terminals 4*a* turned upwardly from the bus bars are inserted into the through holes 5*b* of the printed circuit board 5, as described in the aforementioned Official Gazette, has the following problems to be solved.

A) The plurality of bus bars 4 are formed by punching a single metallic plate into a predetermined shape. However, when the tab terminals 4*a* are turned upwardly, there is the need for punching the metallic plate into a predetermined shape including that of each of the tab terminals 4*a*. Therefore, the area of the metallic original plate increases by the area of the developed tab terminals 4*a*. Thus, the final area of the board increases. This impedes the miniaturization of the circuit.

B) It is necessary for connecting the bus bar board 2 to the printed circuit board 5 that each of the tab terminals 4*a* is accurately aligned with a corresponding one of the through holes 5*b*. However, the step of turning the tab terminals 4*a* upwardly from the bus bars 4 is not easy to perform. It is difficult to accurately align each of the positions, at which the tab terminals are turned upwardly, with a corresponding one of the positions of the through holes 5*b*. Especially, in the case that many tab terminals 4*a* and many through holes 5*b* are provided therein, it is very difficult to accurately align all the tab terminals 4*a* with the through holes 5*b*. Even when all the tab terminals 4*a* could be accurately aligned with the through holes 5*b*, an operation of connecting the tab terminals 4*a* to the through holes 5*b* is very troublesome. Moreover, each of the tab terminals 4*a* is relatively short and possesses high stiffness. This makes it very difficult to connect the tab terminals 4*a* to the circuit board 5 when the positions, at which the tab terminals 4*a* are actually formed, are deviated from the correct positions thereof. Thus, the conventional structure has the problem that it is very difficult to achieve the alignment between the tab terminals 4*a* and the through holes 5*b*.

C) The tab terminals 4*a* are connected to the printed circuit board 5 only by soldering. Thus, the connecting strength therebetween is low. Consequently, it is difficult to maintain the connection between the tab terminal 4*a* and the printed circuit board 5 in a favorable condition against an external force.

SUMMARY OF THE INVENTION

Accordingly, in view of such circumstances, an object of the present invention is to provide a structure and method, which can highly reliably connect bus bars to a printed circuit board by using a simple configuration and performing a simple process without increasing the occupied area of the bus bars.

To achieve the foregoing object, according to an aspect of the present invention, there is provided a circuit board connecting terminal assembly (hereunder referred to simply as a first terminal assembly) for electrically connecting a plurality of bus bars, which constitute an electric circuit, to a printed circuit board, on which a control circuit is mounted. This terminal assembly comprises a plurality of board connecting terminals, each of which has a board connecting portion formed at an end thereof and electrically connected to the printed circuit board by being inserted into a through hole provided in the printed circuit board and also has a pressed-in portion to be press-fitted into a press-fitting hole formed in each of the bus bars by being elastically deformed. These board connecting terminals are fixed to a common insulating connecting element, so that the pressed-in portions of the board connecting terminals face to the same side, that the board connecting portions face, and that the board connecting terminals are formed in such a way as to be arranged in parallel with one another and as to be integral with one another.

When this circuit board connecting terminal assembly is used, a plurality of bus bars and a printed circuit board can easily be connected to one another by performing a method (hereunder referred to as a first method) including the following steps.

That is, first, the first method comprises the step of preliminarily manufacturing the circuit board connecting assembly. In the case that an embodiment (hereunder referred to as a second method) of the first method includes, for example, the step of molding an insulating connecting element around the plurality of board connecting terminals arranged in parallel with one another as a practical process for preliminarily manufacturing the assembly, the second method excels in mass-productivity. The circuit board connecting terminal assembly (hereunder referred to as a second terminal assembly) manufactured in this way, that is, a molding product obtained by molding the insulating connecting element around the plurality of board connecting terminals arranged in parallel with one another excels in strength, because each of the board connecting terminals is firmly fixed to the insulating connecting element.

The first method further comprises the step of attaching the assembly to the printed circuit board. That is, the board connecting portions of the board connecting terminals of the terminal assembly are inserted into the through holes and then connected and fixed to the printed circuit board. At this step, a printed circuit board (hereunder referred to as a first printed circuit board) with board connecting terminals are produced in such a way as to comprise a circuit board terminal assembly, and a printed circuit board having a control circuit mounted thereon and a plurality of through holes provided therein so that each of board connecting portions of board connecting terminals of the terminal assembly is electrically connected to the printed circuit board by being inserted into a corresponding one of the plurality of through holes. In this printed circuit board, the board connecting terminals of the circuit board connecting terminal assembly are fixed thereto by being bound thereto by an insulating connecting element. Thus, the fixed state thereof is stable. Further, the printed circuit board excels in strength. Moreover, the connection between the printed circuit board and each of the board connecting terminals is maintained in a stable state and highly reliable. Therefore, the following step of press-fitting pressed-in portions into press-fitting holes is performed without strength problem.

Especially, in the case of an embodiment (hereunder referred to as a second printed circuit board) of the first printed circuit board, the board connecting portions of the board connecting terminals are inserted into the through holes provided in the printed circuit board to a position at which the connecting portions are placed when the insulating connecting element of the circuit board connecting terminal assembly touches a surface of the printed circuit board. In this case, the fixed state is more stable with higher reliability of the connection between the printed circuit board and each of the board connecting terminals.

The first method further comprises the step of forming the press-fitting holes and the step of fitting the pressed-in portions into the press-fitting holes. That is, the press-fitting holes are formed in the bus bars, respectively. Then, the pressed-in portions of the board connecting terminals are press-fitted into the press-fitting holes and electrically connected to the bus bars, respectively. The electrical connection between the printed circuit board and each of the bus bars can easily be performed by such a press-fitting operation.

According to the connecting method comprising the aforementioned steps, the circuit board connecting terminal assembly is first manufactured. Then, the board connecting portion of each of the board connecting terminals is inserted into a corresponding one of the through holes formed in the printed circuit board and fixed thereto. Subsequently, the pressed-in portion at the opposite side of each of the terminals is press-fitted into a corresponding one of the press-fitting holes formed in the bus bars. Thus, as compared with the case of the conventional structure, in which the tab terminals of the bus bars are directly inserted into the through holes formed in the printed circuit board, the alignment between the tab terminals and the through holes is easier to perform in the case of a structure obtained according to the invention. Moreover, halfway through the manufacture of the structure, the electrical connection between the printed circuit board and each of the board connecting portions can be maintained in a favorable condition by the insulating connecting element connecting the terminals in such a manner as to be bound to one another.

Further, according to the circuit board connecting structure (hereunder referred to as the first structure) obtained in this manner, the electrical contact between the pressed-in portions and the bus bars are reliably maintained by elastic forces of the pressed-in portions.

Especially, in the case of an embodiment (hereunder referred to as a second structure) of the first structure, the press-fitting holes of the bus bars are formed by partly bending the press-fitting holes of the bus bars in a direction, in which the pressed-in portions are inserted, and constituted so that the pressed-in portions are pressure-contacted onto the surfaces of the bent parts of the pressed-in portions, the second structure gains the depth of the press-fitting holes by forming the bent parts even when the thickness of each of the bus bars is small. Thus, the electrical contact between the inside surfaces (that is, the surfaces of the bent parts) of the press-fitting holes and the pressed-in portions of the board connecting terminals is stably maintained.

DETAILED DESCRIPTION OF THE PREFERRED EMBODIMENTS

Preferred embodiments of the invention will be described hereinafter with reference to the accompanying drawings.

A circuit board connecting method according to this embodiment includes the following steps.

1) Step of Manufacturing Assembly

Figure 1:
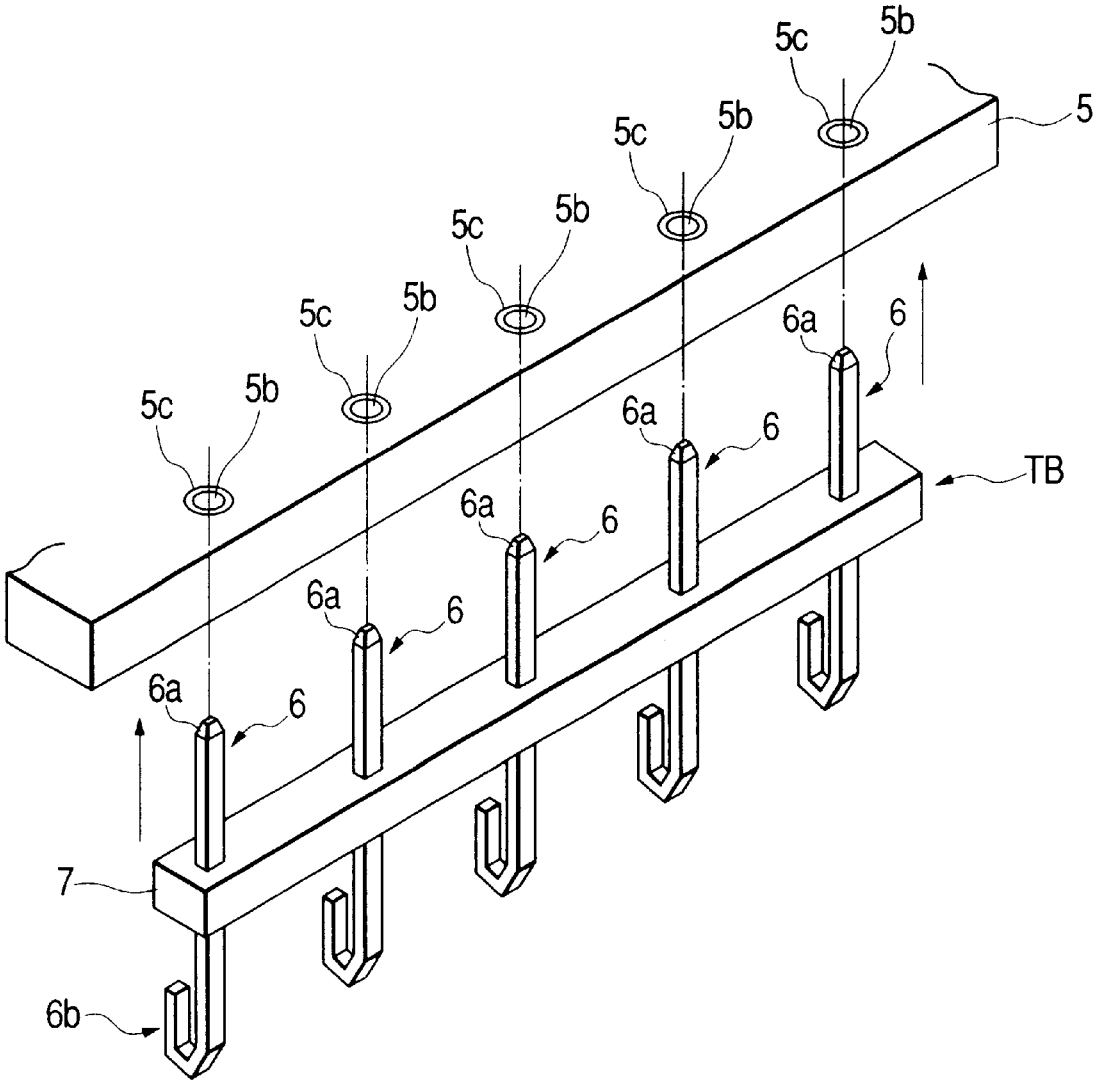
FIG. 1 is a perspective view illustrating a step of attaching to a printed circuit board a circuit board connecting terminal assembly according to an embodiment of the invention.

At this step, a circuit board connecting terminal assembly TB shown in FIG. 1 is manufactured.

This terminal assembly TB has a plurality of (in this embodiment shown in this figure, five) board connecting terminals 6, which are formed by using a single insulating connecting element 7 in such a way as to be integral with one another. This assembly is used for electrically connecting a printed circuit board shown in FIG. 1 to a plurality of bus bars 4.

Each of the board connecting terminals 6 is formed by bending a metallic pin having favorable electric conductivity, and has a board conducting portion 6*a* provided at an end thereof and also has a pressed-in portion at the other end thereof.

The board connecting portions 6*a* are inserted into a plurality of through holes 5*b* provided in the printed circuit board 5, respectively. In the embodiment shown in this figure, to facilitate the insertion of the connecting portions 6*a*, each of the portions 6*a* is formed in such a way as to taper off. The inner circumferential surface of each of the through holes 5*b* is plated with a metallic plating layer 5*c*. Each of the plating layer 5*c* is electrically connected to a circuit composing conductor of the printed circuit board 5. Further, the section of each of the board connecting portions 6*a* is shaped so that when the board connecting portions 6*a* are inserted into the through holes 5*b*, the outer surface of each of the portions 6*a* is brought into contact with and connected to the plating layer 5*c*.

Figure 3:
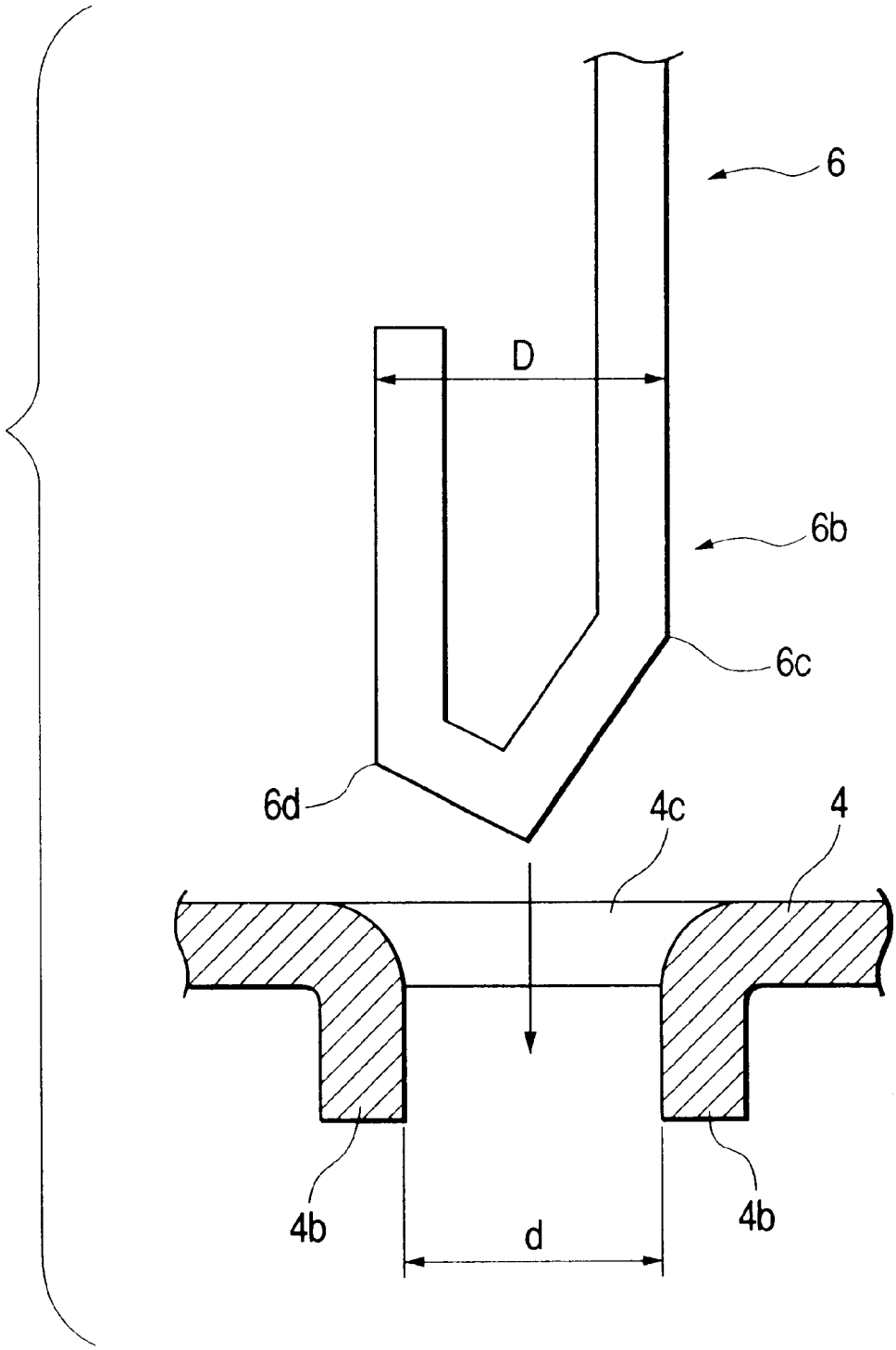
FIG. 3 is a sectional plan view illustrating the step of press-fitting the pressed-in portion.

As illustrated in FIG. 3, an end portion of each of the board connecting terminals 6 is shaped nearly like a letter "J" by being bent at a plurality of places, so that the width D of the pressed-in portion 6*b* itself is variable owing to warpage deformation thereof.

The insulating connecting element 7 is used for connecting the board connecting terminals 6 to one another in such a manner as to be electrically insulated from and integral with one another. This connection results in the arrangement of the board connecting terminals 6, in which the pressed-in portions thereof are turned downwardly, and in which the board connecting portions thereof are turned upwardly, and in which the board connecting terminals 6 are held in such a manner as to be arranged in a row with the pitch that is equal to the pitch of the through holes 5*b*. In the case of the embodiment illustrated in this figure, the terminal assembly TB is manufactured by molding the insulating connecting element 7 around the board connecting terminals 6, which are arranged in such a state, by using synthetic resins.

Figure 4:
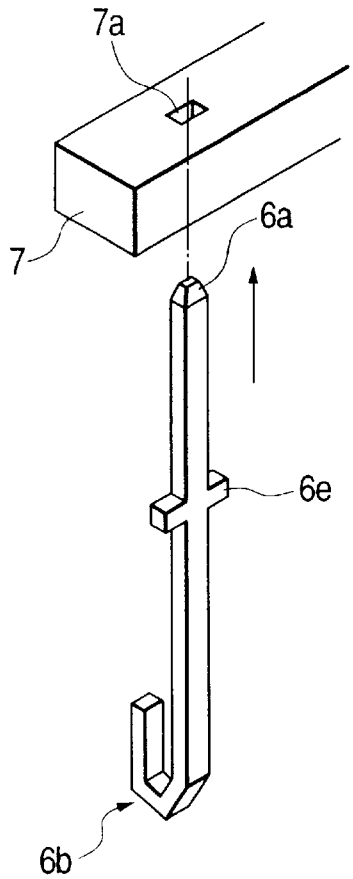
FIG. 4 is a perspective view illustrating a modification of a method of manufacturing the circuit board connecting terminal assembly.
Figure 5:
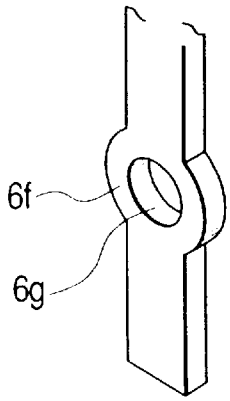
FIG. 5 is a perspective view illustrating a modification of the pressed-in portion of the board connecting terminal.

Incidentally, a method for fixing this insulating connecting element 7 and the board connecting terminals 6 is not limited to the method of molding the insulating connecting element therearound. For instance, the element 7 and the terminals 6 may be fixed by preliminarily forming through holes 7*a* in the element 7 and then press-fitting each of the terminals 6 to a corresponding one of the through holes 7*a* from the side of the connecting portion 6*a* thereof, as illustrated in FIG. 4. In this case, preferably, a stop portion 6*e* is provided in a middle portion of the board connecting terminal 6 in such a way as to project outwardly therefrom, as illustrated in this figure. This stop portion 6*e* is effective in the case that the board connecting terminals 6 and the insulating connecting element 7 are integrally formed by molding.

Further, it is not always necessary that the board connecting terminals 6 are arranged in a line. The terminals 6 may be suitably set according to the arrangement of the through holes 5*b* at the side of the printed circuit board 5 or according to the layout of the bus bars. For example, the zigzag or block-like layout of the board connecting terminals 6 may be employed.

2) Step of Attaching Assembly

Figure 2:
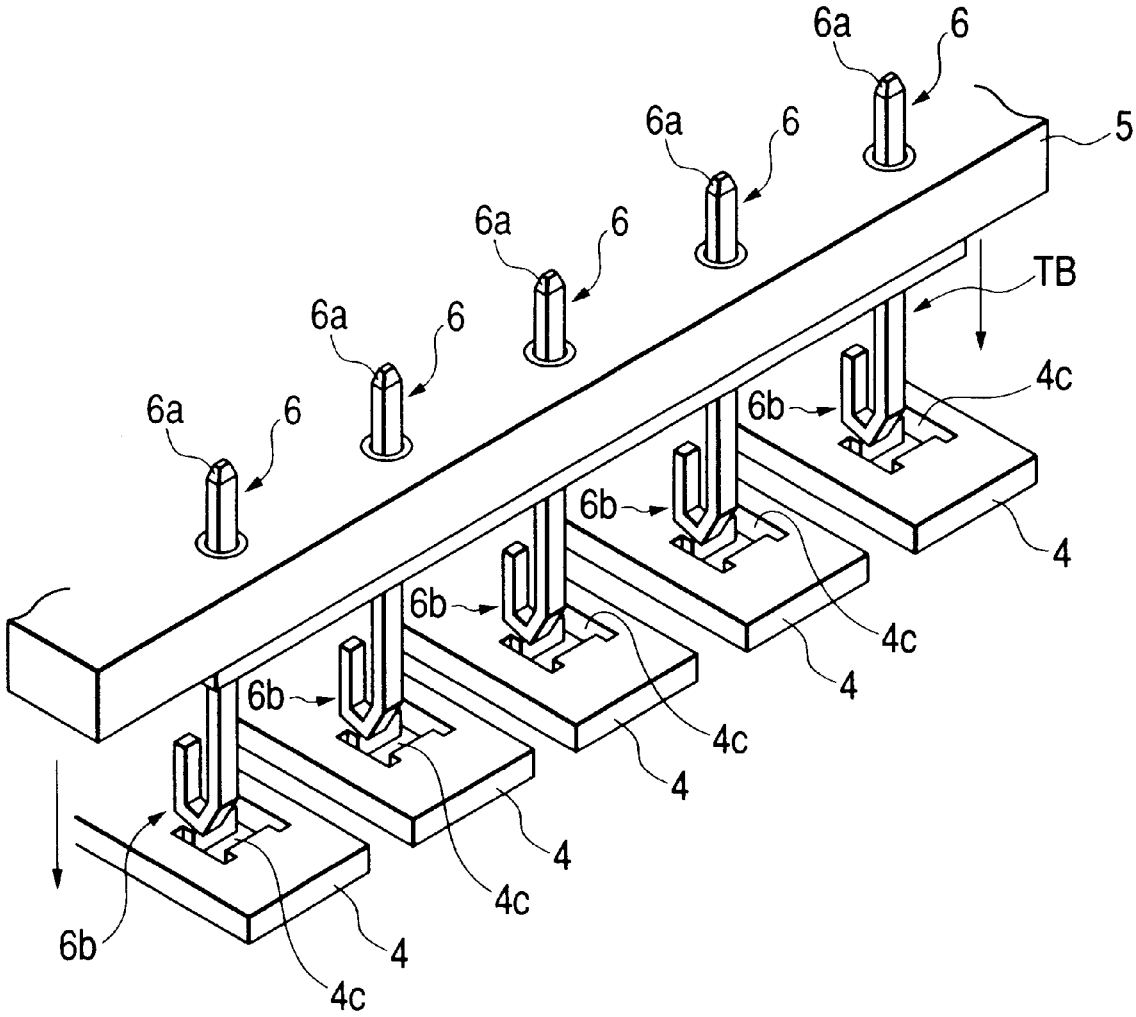
FIG. 2 is a perspective view illustrating a step of press-fitting a pressed-in portion of each of the board connecting terminals of the circuit board connecting terminal assembly attached to the printed circuit board into a corresponding one of press-fitting holes of bus bars.

The board connecting portion 6*a* of each of the board connecting terminals 6 is inserted into a corresponding one of the through holes 5*b* of the printed circuit board 5 to a position at which the connecting portion 6*a* is placed when the top surface of the insulating connecting element 7 of the board connecting terminal assembly TB touches the bottom surface of the printed circuit board 5. Then, each of the board connecting terminals 6 is electrically connected to the circuit mounted on the printed circuit board 5 by suitably soldering a corresponding connecting portion 6*a* thereto. Moreover, the circuit board connecting terminal assembly TB is fixed to the printed circuit board 5. That is, as illustrated in FIG. 2, the printed circuit board having the board connecting terminals is formed so that a plurality of board connecting terminals 6 project from the bottom surface of the printed circuit board 5. In this printed circuit board having the board connecting terminals, the circuit board connecting terminal assembly TB is fixed in a state in which the insulating connecting element 7 of the terminal assembly TB touches the surface of the printed circuit board. Thus, such a fixing state of the assembly TB is stable. Further, the printed circuit board excels in strength. Moreover, the connection between the printed circuit board 5 and each of the board connecting terminals 6 is maintained in a stable condition with high reliability. Furthermore, even when the insulating connecting element 7 does not touch the printed circuit board 5, the board connecting terminals 6 are connected by the insulating connecting element 7 in such a way as to be bound to one another. Thus, the fixing state is more stable, as compared with the case of employing the conventional structure. Therefore, even when an external force is applied thereto at a step of press-fitting the pressed-in portions (to be described later in Section 4), the connection therebetween is maintained in a favorable condition.

3) Step of Forming Holes

At this step, a press-fitting hole 4*c* is formed at an appropriate place in each of the bus bars 4. In this embodiment illustrated in the figures, a slit is formed nearly like a letter "H" in an end portion of each of the bus bars 4. Then, each of the press-fitting holes 4*c* is formed by downwardly bending lateral portions surrounded by this slit. In the case of each of the press-fitting holes 4*c*, the depth thereof is increased by the length of each of the bent portions 4*b*. Incidentally, the distance d between both the bent portions 4*b* (that is, the width of each of the press-fitting holes 4*c*) is preliminarily set in such a manner as to be slightly smaller than the width D of the pressed-in portion 6*b*, which is in an non-deformed condition, of each of the board connecting terminals 6.

Further, the shape and configuration of the pressed-in portions of the invention are not limited to specific shape and configuration. Any parts, which can be press-fitted into the press-fitting holes of the bus bars when elastically deformed, may be employed as the pressed-in portions. For example, a pressed-in portion may be provided by forming a bulge portion 6*f* in an end portion of each of the board connecting terminals 6, which are formed like rectangles, in such a way as to protrude outwardly in the direction of width thereof, and further forming an elongated hole 6*g* for warpage deformation, in the central part of this bulge portion 6*f*.

Furthermore, a time, at which this step of forming the holes is performed, is not limited to a specific time. The step of forming the holes may be performed concurrently with the step of manufacturing the assembly and the step of attaching the assembly. Alternatively, the step of forming the holes may be performed before or after the step of manufacturing the assembly or the step of attaching the assembly.

4) Step of Press-fitting Pressed-in Portions

At this step, the pressed-in portion 6*b* of each of the board connecting terminals 6 is press-fitted into a corresponding one of the press-fitting holes 4*c* and electrically connected to a corresponding one of the bus bars 4. Practically, the pressed-in portion 6*b* of each of the board connecting terminals 6 is pushed into a corresponding one of the press-fitting holes 4*c* of the bus bars 4 from above by utilizing the warpage (that is, elastic deformation) of the pressed-in portion 6*b*. Then, the outer corner parts (that is, corner parts 6*c* and 6*d*) of the pressed-in portion 6*b* are pressure-contacted onto the inner surfaces of the peripheral bent portions 4*b* of the corresponding press-fitting hole 4*c*. This results in the electrical connection between the board connecting terminals 6 and the bus bars 4. Consequently, the control circuit mounted on the printed circuit board 5 is electrically connected through each of the board connecting terminals 6 to a proper one of the bus bars 4.

Incidentally, the aforementioned connecting structure and method can be applied not only to the connection between the bus bar board and the printed circuit board of the conventional junction box but to a wide variety of apparatuses. FIGS. 6 to 10 illustrate a power distributor, which is used for distributing electric power to a plurality of electronic units from a vehicle-mounted power supply, as an example to which the invention can effectively be applied.

Figure 6:
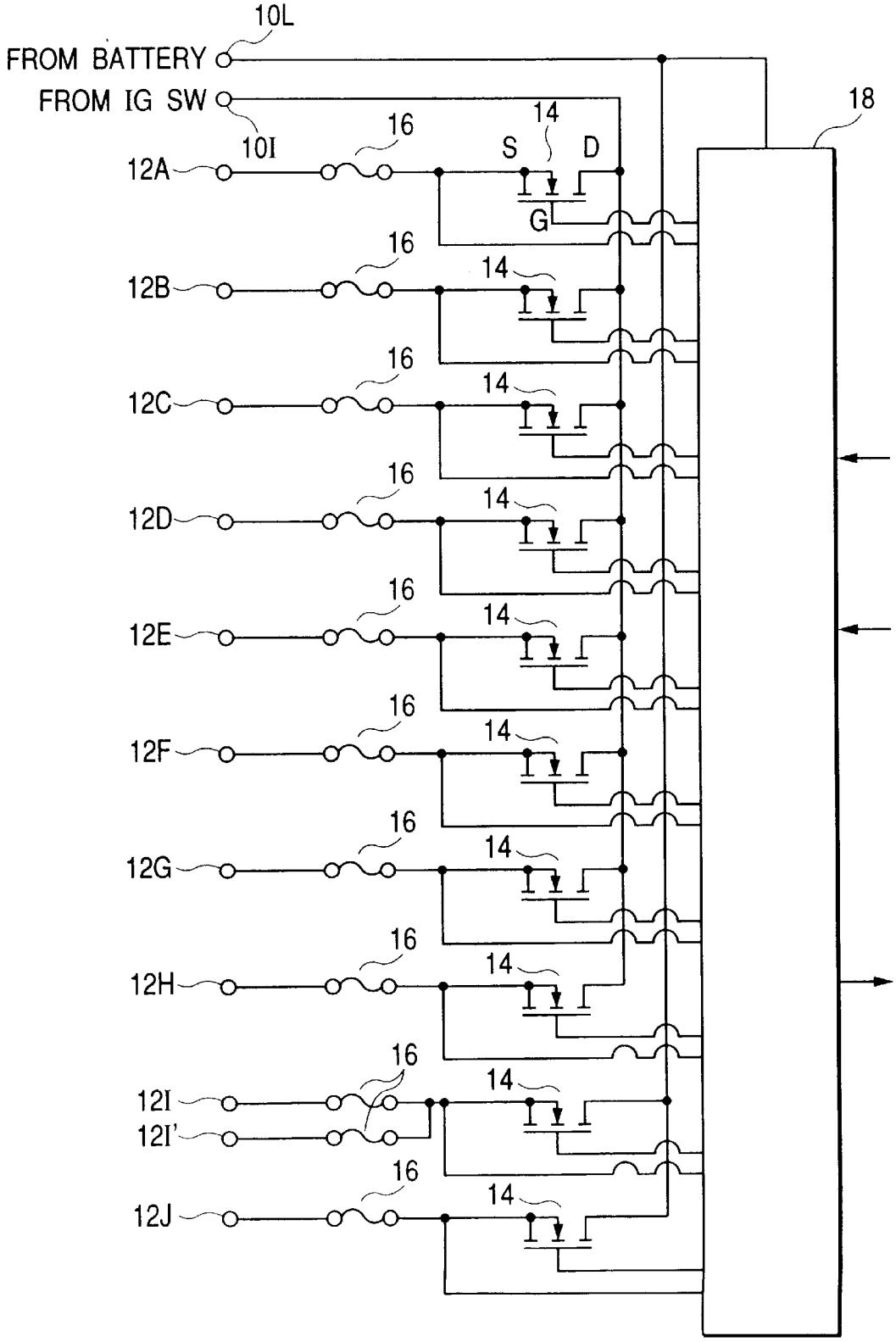
FIG. 6 is a circuit diagram illustrating a power distributor to which the invention can be applied.

As shown in FIG. 6, this power distributor has a first input terminal 10I, a second input terminal 10L, a plurality of (in the case of the embodiment illustrated in this figure, eleven) output terminals 12A, 12B, 12C, 12D, 12E, 12F, 12G, 12H, 12I, 12I', and 12J, a plurality of (in the case of the embodiment illustrated in this figure, ten) semiconductor switching devices in the case of the embodiment illustrated in this figure, power MOS FETs 14 (hereunder referred to as "FETs"), and a control circuit board 18 serving as the printed circuit board.

Both the input terminals 10I and 10L are connected to the common vehicle-mounted power supply (for instance, a battery). Between these input terminals, the first input terminal 10I is connected to the vehicle-mounted power supply through an ignition switch (not shown), while the second input terminal 10L is directly connected to the vehicle-mounted power supply.

Among the output terminals 12A to 12J, the output terminals 12A to 12H are connected to the electronic units (for example, a center cluster unit, an air-conditioning unit, and a door unit), which are supplied with electric power by operating the ignition switch. The remaining output terminals 12I, 12I', and 12J are connected to electronic units directly supplied with electric power, for example, lamp units.

A fuse portion 16 adapted to fuse at an occurrence of an overcurrent is provided at a halfway portion between the control circuit board and each of the output terminals 12A, 12B, 12C, 12D, 12E, 12F, 12G, 12H, 12I, 12I', and 12J.

Each of source terminals of the FETs 14 is connected to a corresponding one of the output terminals 12A, 12B, 12C, 12D, 12E, 12F, 12G, 12H, 12I, and 12J. The source terminal of the FET 14, which is connected to the 12I, is simultaneously connected to the output terminal 12I'. That is, the common FET 14 is connected to both the output terminals 12I and 12I'. All drain terminals of the FETs 14 connected to the output terminals 12A to 12H are connected to the first input terminal 10I, while all drain terminals of the FETs 14 connected to the output terminals 12I, 12I', and 12J are connected to the second input terminal 10L. Therefore, source power inputted to the first input terminal 10I is distributed to electronic units connected to the output terminals 12A to 12H through the FETs 14, whereas supply power inputted to the second input terminal 10L is distributed to the electronic units connected to the output terminals 12I, 12I', and 12J through the FETs 14.

All the gate terminals of the FETs 14 are connected to the control circuit mounted on the control circuit board 18. A power supply voltage applied to the second input terminal 10L and a source voltage of each of the FETs 14 are inputted to this control circuit. This control circuit controls energization of each of the FETs 14 according to operating signals (such as switch signals) inputted from an external circuit. Moreover, the control circuit detects electric current flowing through each of the FETs 14 from the difference in potential level between the power supply voltage and the source voltage of a corresponding one of the FETs 14. When this current exceeds an allowable range, the control circuits turns off the corresponding FET 14 and outputs a warning signal to a display unit (not shown).

Figure 7:
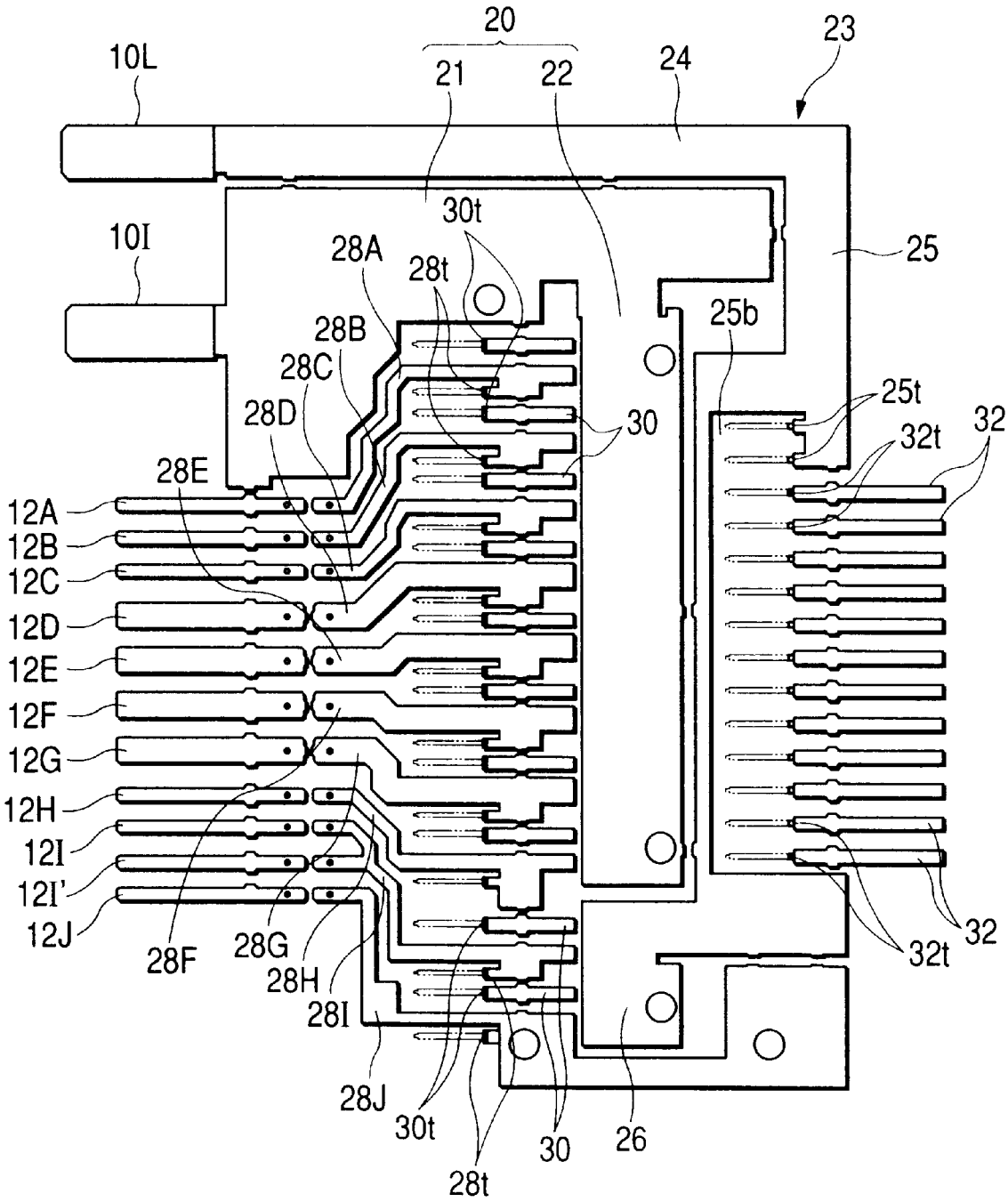
FIG. 7 is a plan view illustrating a conductor portion of the power distributor.
Figure 8:
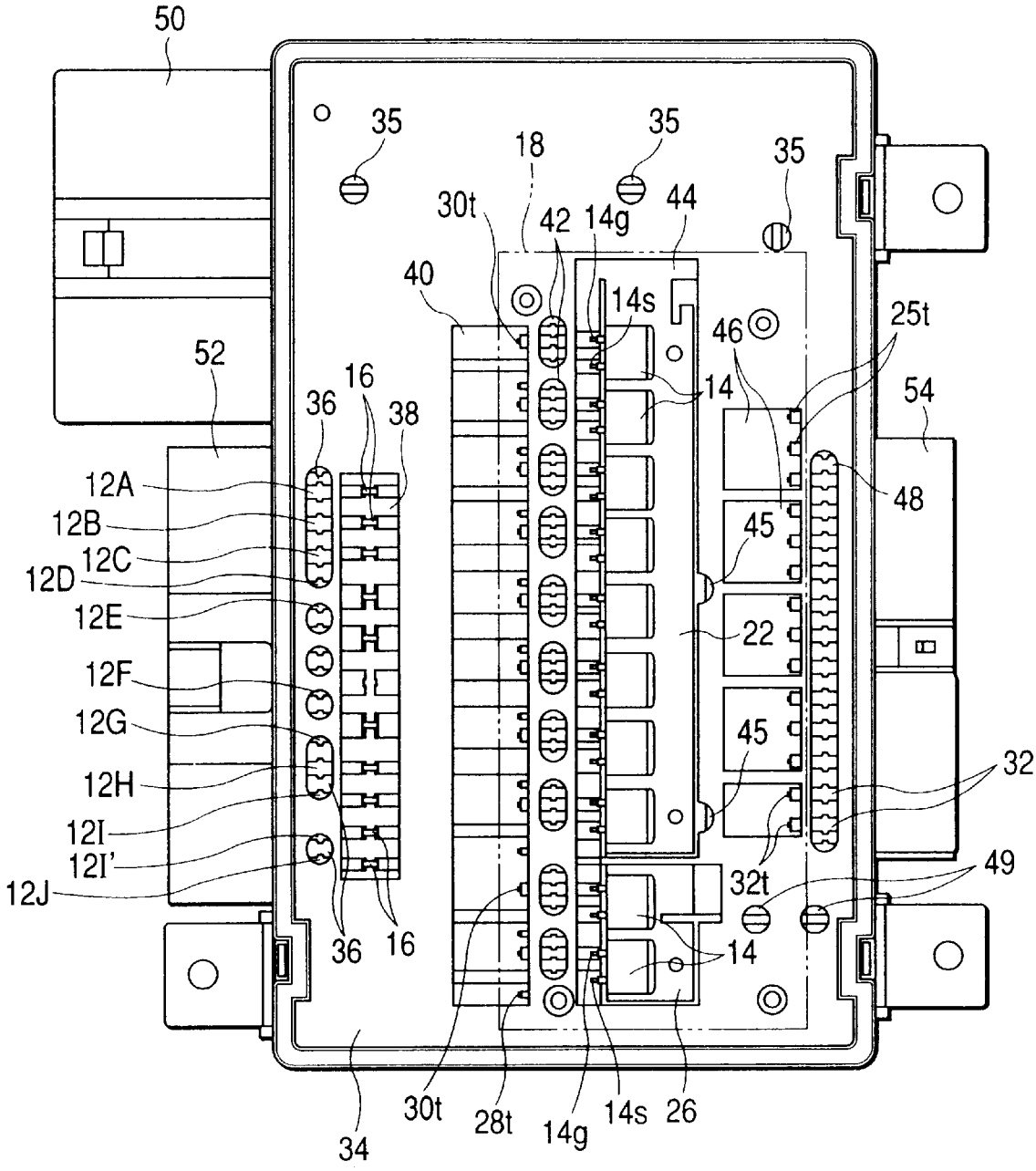
FIG. 8 is a plan view illustrating the entire power distributor.
Figure 9A:
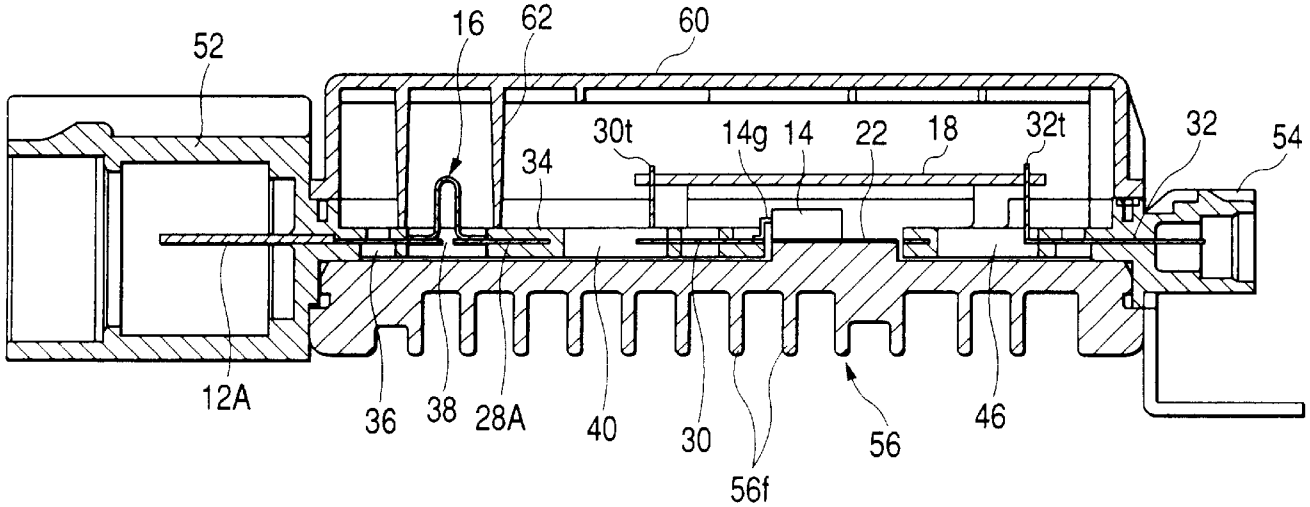
FIG. 9A is a sectional front view illustrating the power distributor.
Figure 9B:
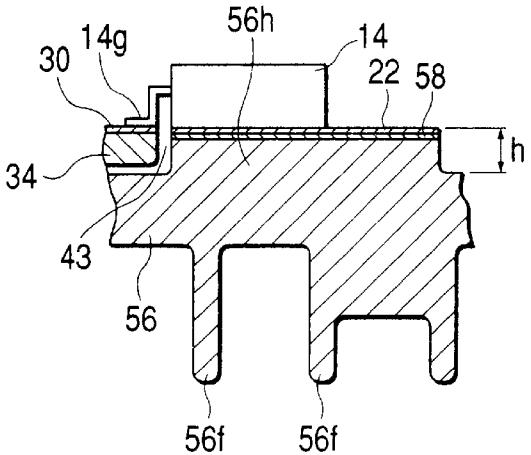
FIG. 9B is an enlarged sectional view illustrating an FET mounting portion.
Figure 10:
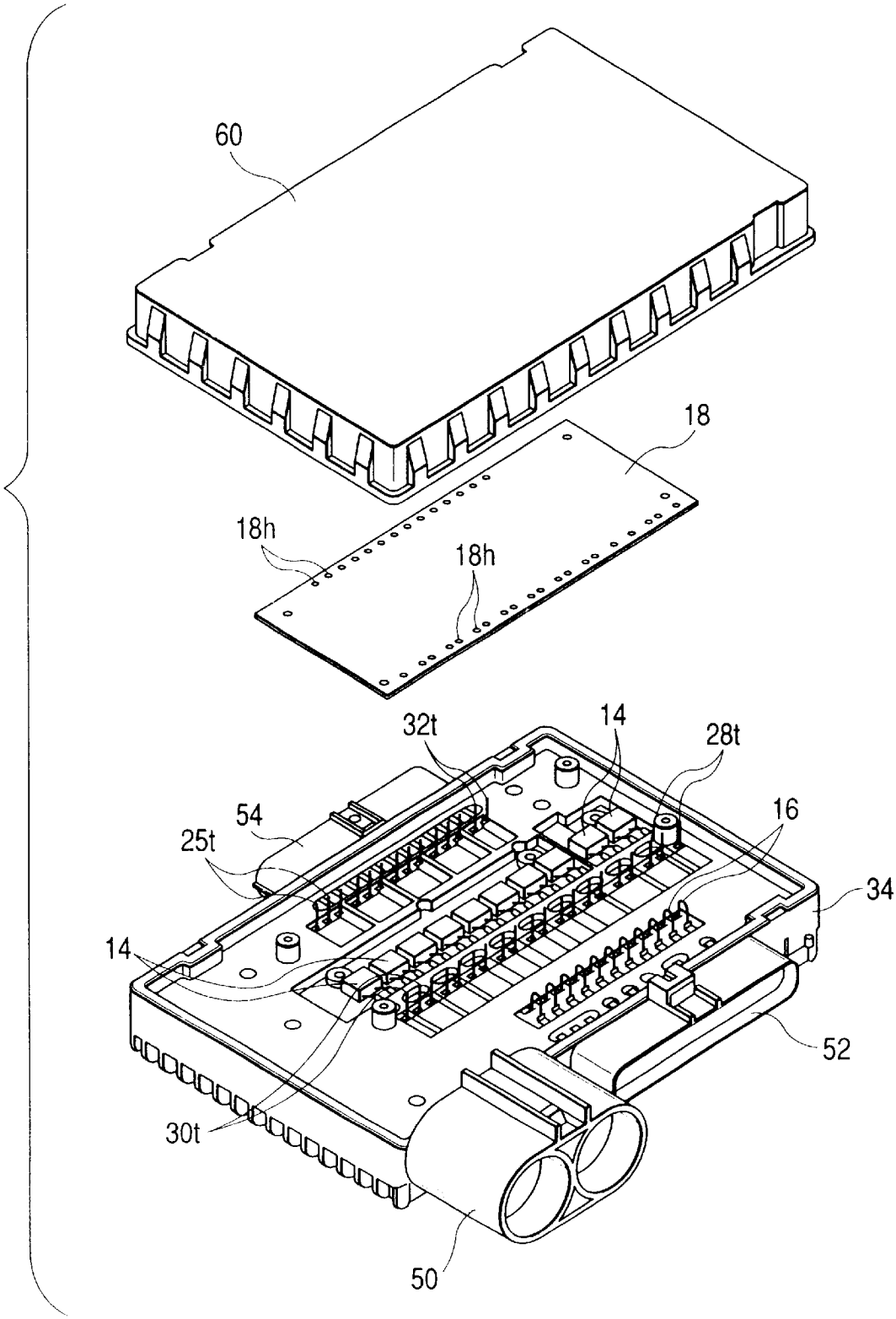
FIG. 10 is an exploded perspective view illustrating the power distributor, which is taken from above.
Figure 11:
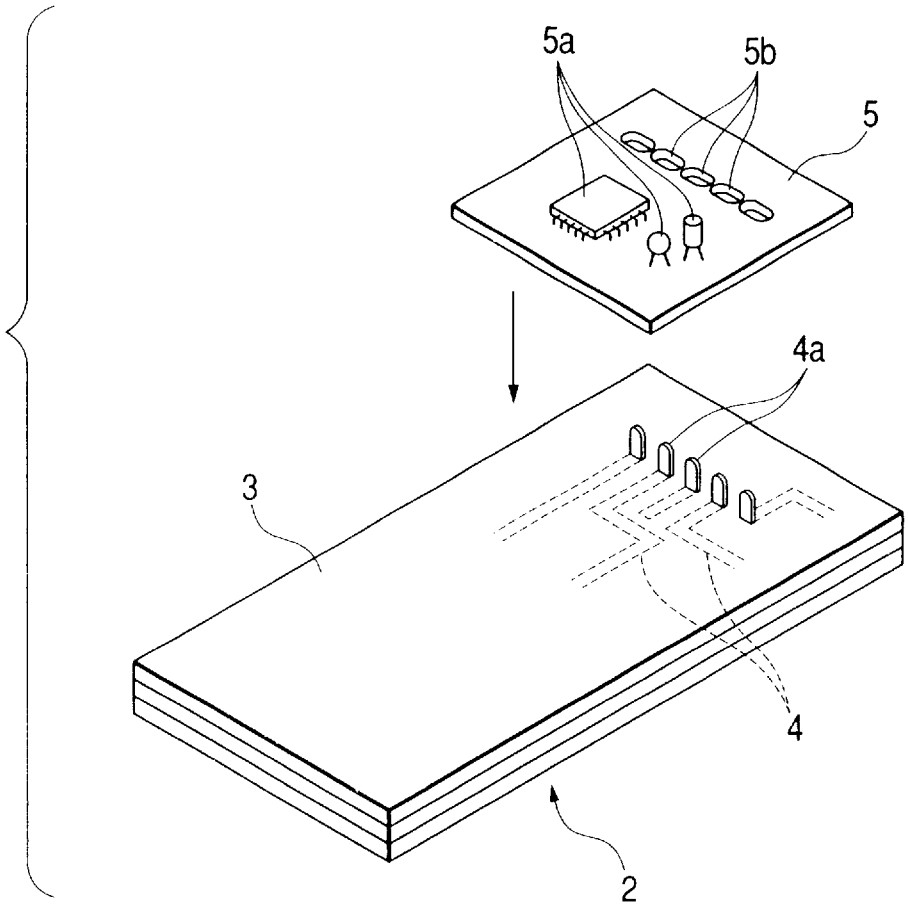
FIG. 11 is a perspective view illustrating a bus bar board and a printed circuit board in a conventional junction box.
Figure 12:
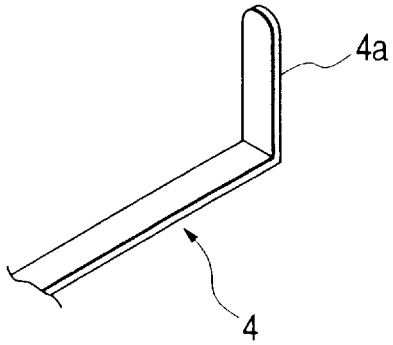
FIG. 12 is a perspective view illustrating a tab terminal formed in an end portion of a bus bar in the bus bar board.

All conductors composing a distribution circuit of this power distributor are constituted by metallic plates, which are arranged on the same plane perpendicular to the direction of thickness thereof and integrally formed by resin molding. FIG. 7 is a plan view illustrating only a portion constituted by the metallic plates, which would be seen through the resin mold.

As illustrated in this figure, the first input terminal 10I and the second input terminal 10L are formed in such a way as to be integral with the end portions of the metallic plates 20 and 23, respectively. The metallic plate 20 has a junction portion 21, which extends from the first input terminal to the inner side (that is, the right side, as viewed in FIG. 7), and a drain connecting portion 22 formed in such a way as to extend from the innermost end of this junction portion 21 in a direction orthogonal to the junction portion 21 and to be integral with the junction portion 21. The metallic plate 23 has a first junction portion 24, which extends from the second input terminal 10L through a space provided along the outer side (that is, the upper side, as viewed in FIG. 7) of the junction portion 21 of the metallic plate 20 and in parallel with the drain connecting portion 22, a second junction portion 25, which extends from the innermost end of this first junction portion 24 through a space provided along the outer side (that is, the right side, as viewed in FIG. 7) and in parallel with the drain connecting portion 22, and a drain connecting portion 26 formed in such a manner as to extend frontwardly from an end of the second junction portion 25 and to be integral with the first junction portion 24 and the second junction portion 25. The drain connecting portions 26 and 22 are arranged in a line along the longitudinal direction (that is, the upward or downward direction, as viewed in FIG. 7) of the drain connecting portion 22.

All the output terminals 12A to 12J are arranged in a row together with both the input terminals 10I and 10L in such a way as to project in the same direction as the direction in which the input terminals 10I and 10L extend. At the rear side of each of the output terminals 12A, 12B, 12C, 12D, 12E, 12F, 12G, 12H, 12I, and 12J, a corresponding one of junction portions 28A, 28B, 28C, 28D, 28E, 28F, 28G, 28H, 28I, and 28J each extending therefrom to the position at which each of these junction portions adjoins the drain connecting portions 22 and 26. Further, the junction portion 28I corresponding to the output terminal 12I branches into the output terminal 12I'. Further, the drain connecting portion 22 is disposed at the position at which the portion 22 adjoins the innermost ends of the junction portions 28A to 28H, among the junction portions 28A to 28J. The drain connecting portion 26 is placed at the position at which the portion 26 adjoins the innermost ends of the junction portions 28I and 28J.

Furthermore, each of control terminals 30, each of which is constituted by a nearly rectangular metallic plate, is disposed at the place adjoining a corresponding one of the junction portions 28A to 28J. That is, the junction portions and the control terminals are alternately arranged in a row, for instance, in the following order: the control terminal 30, the junction portion 28A, the control terminal 30, the junction portion 28B, the control terminal 30, etc.

The drain terminal of each of the FETs is formed on the back surface of a chip body. The source terminal 14*s* and the gate terminal 14*g* of each of the FETs project from the chip body in the same direction. Further, the FETs 14 are arranged in a line on each of the drain connecting portions 22 and 26 according to the arrangement and pitch of the junction portions 28A to 28J. Moreover, in a state in which the drain terminals of the FETs 14 directly touch the drain connecting portions 22 and 26, the FETs 14 are mounted on the drain connecting portions 22 and 26 by welding (or, for instance, soldering). Furthermore, the source terminals of the FETs 14 are electrically connected to the rear ends of the junction portions 28A to 28J, respectively. The gate terminals 14*g* of the FETs 14 are electrically connected to the rear ends of the control terminals 30, respectively.

In the power distributor illustrated in the figure, each of the rear parts of the junction portions 28A to 28J branches into a claw portion. Tabs 28*t* are formed by turning such claw portions upwardly. Similarly, a claw portion is formed at the front part of each of the control terminals 30. Tabs 30*t* are formed by turning these claw portions upwardly.

On the other hand, a rectangular cutout 25*b* extending in parallel with the drain connecting portion 22 is formed in the second junction portion 25 of the metallic plate 23. A plurality of signal terminals 32 are disposed in a space of this cutout 25*b*. Each of the signal terminals 32 is formed like a narrow rectangle. The signal terminals 32 are arranged in a row in a direction, which is parallel to the longitudinal direction of the drain connecting portion 22, and project therefrom in an orientation opposite to the orientation in which the input terminals 10I and 10L and the output terminals 12A to 12J project therefrom. Each of the rear portions of the signal terminals 32 branches into a claw portion. Tabs 32*t* are formed by turning such claw portions upwardly.

Further, a claw portion is formed in a part, which adjoins the signal terminals 32, of the second junction portion 25. Then, a tab 25*t* is formed by turning this claw portion upwardly. Furthermore, all of this tab 25*t* and the tabs 28*t*, 30*t*, and 32*t* are connected to the common control circuit board 18.

The control circuit board 18 is disposed at a position just above the FETs 14 (that is, the position at which the circuit control board 18 is separated from the FETs 14) in such a way as to be nearly parallel to a plane in which the terminals are placed. Further, the tabs 28*t*, 30*t*, 32*t*, and 25*t* are mechanically connected to the control circuit board 18 by soldering in a state in which the tabs 28*t*, 30*t*, 32*t*, and 25*t* are inserted into through holes 18*h*. Moreover, the output terminals 12A to 12J, the control terminals 30, the signal terminals 32, and the second input terminal 10L are electrically connected to the control circuit mounted on the control circuit board 18. That is, this control circuit board 18 is disposed between the control terminals 30 and the signal terminals 32 in such a way as to straddle the FETs 14.

The resin mold integrating the terminals constitutes a case body 34 of the power distributor. A cover 60 is attached thereto. A rectangular fuse window 38 for exposing divided portions of the output terminals 12A to 12J to upward and downward sides, and an element window 44 for exposing the drain connecting portions 22 and 26 to upward and downward sides are formed at suitable places in this case body 34. The fuse portions 16 are disposed in the fuse window 38. In the element window 44, the FETs 14 are mounted on the drain connecting portions 22 and 26.

Connector housing portions 50 and 52 are integrally formed on a side surface of the case body 34, while a connector housing portion 54 is formed on the other side surface thereof. These connector housing portions 50, 52, and 54 are formed like outwardly opened hoods. Further, the case body 34 is formed so that both the input terminals 10I and 10L laterally adjoining each other project into the connector housing portion 50, that all the output terminals 12A to 12J arranged in a row project into the connector housing portion 52, and that all the signal terminals 32 arranged in a row project into the connector housing portion 54. That is, the terminals 10I, 10L, 12A to 12J, and 32 outwardly protruding from the case body 34 constitute male terminals of a connector formed in such a manner as to be integral with the case body 34.

Incidentally, a heat radiating member 56 having fins 56*f* is disposed on the back surface of the case body 34. A base portion 56*h* formed on the inner surface of the case body 34 is thermally connected to the drain connecting portions 22 and 26 through an insulating sheet 58 made of silicone (FIG. 9B) by way of a window 43 formed in the case body 34.

The body of the power distributor described above is manufactured a follows. That is, first, a sheet of metallic plate is punched into the shape shown in FIG. 7 by pressing. Then, the resin mold constituting the case body is formed therearound. Subsequently, connecting portions 27, 11, 29, 31, and 33 of the original plate are cut through the windows 35, 36, 42, 48, and 49 formed in this resin mold by pressing. Moreover, the FETs 14 are mounted on the drain connecting portions 22 and 26. Further, the connection between the bus bar circuit board and the control circuit board (that is, the printed circuit board) 18 is performed as follows. That is, first, the tabs 28*t*, 30*t*, 25*t*, and 32*t* are formed by turning the claw portions upwardly in the windows 40 and 46. Then, these tabs are inserted into through holes 18*h* of the printed circuit board 18 and soldered thereto. Therefore, the area of the original plate for bus bars should be increased by the area required to preliminarily form the claw portions. Consequently, the miniaturization of the power distributor is difficult to perform.

In contrast, when the connection between the control circuit board 18 and each of the bus bars is performed by using the circuit board connecting terminal assembly TB shown in FIG. 1 instead of forming the claw portions, the area of the original plate can be reduced by the area of the claw portions to be omitted. Consequently, the miniaturization of the entire power distributor is achieved.

As described above, according to the invention, the circuit board connecting terminal assembly, in which the plurality of board connecting terminals each having a circuit board connecting portion and a pressed-in portion are integrally formed by using the insulating connecting element, is preliminarily manufactured. Then, the bus bars are electrically connected to the printed circuit board by using this circuit board connecting terminal assembly. The invention has the effects that the bus bars can highly reliably be connected to the printed circuit board by employing a simple configuration and performing a simple process without increasing the occupied area of the bus bars, differently from the conventional structure in which the tab terminals are formed by upwardly turning the end portions of the bus bars.

What is claimed is:

1. A circuit board connecting terminal assembly for electrically connecting a plurality of bus bars, which constitute an electric circuit, to a printed circuit board, on which a control circuit is mounted, said terminal assembly comprising:

a plurality of board connecting terminals, each of which has a board connecting portion formed at an end thereof and electrically connected to said printed circuit board by being inserted into a through hole provided in said printed circuit board and also has a pressed-in portion to be press-fitted into a press-fitting hole formed in each of said bus bars by being elastically deformed; and a common insulating connecting element to which said board connecting terminals are fixed, so that said pressed-in portions of said board connecting terminals face to the same side, that said board connecting portions face to the same side, and that said board connecting terminals are arranged in parallel with one another and as to be integral with one another.

2. The circuit board connecting terminal assembly according to claim 1, which is a molding product obtained by molding said insulating connecting element around said plurality of board connecting terminals arranged in parallel with one another.

3. A printed circuit board with board connecting terminals, comprising:

said board terminal assembly according to claim 1; and a printed circuit board having a control circuit mounted thereon and a plurality of through holes provided therein so that each of board connecting portions of board connecting terminals of said terminal assembly is electrically connected to said printed circuit board by being inserted into a corresponding one of said plurality of through holes.

4. The printed circuit board with board connecting terminals according to claim 3, wherein said board connecting portions of said circuit board connecting terminals are inserted into the through holes provided in said printed circuit board to a position at which said connecting portions are placed when said insulating connecting element of said board connecting terminal assembly touches a surface of said printed circuit board.

5. A circuit board connecting structure comprising:

said printed circuit board having board connecting terminals according to claim 4; and a plurality of bus bars constituting an electric circuit, wherein a press-fitting hole is provided in each of said plurality of bus bars, and wherein said pressed-in portion of each of said board connecting terminals is electrically connected to a corresponding one of said bus bars by being press-fitted into the press-fitting holes.

6. The circuit board connecting structure according to claim 5, wherein the press-fitting holes of said bus bars are formed by partly bending the press-fitting holes of said bus bars in a direction, in which said pressed-in portions are inserted, and wherein said pressed-in portions are pressure-contacted onto surfaces of said bent parts of said pressed-in portions.

7. A circuit board connecting method for electrically connecting a plurality of bus bars, which constitute an electric circuit, to a printed circuit board, on which a control circuit is mounted, said method comprising the steps of:

manufacturing said board connecting terminal assembly according to claim 1;

inserting a board connecting portion of each of said board connecting terminals of said board connecting terminal assembly into a corresponding one of the through holes to thereby connect said board connecting portion to said printed circuit board and to fix said board connecting terminal assembly to said printed circuit board; and press-fitting each of said pressed-in portions of said board connecting terminals into a corresponding one of the press-fitting holes to thereby electrically connect said pressed-in portions to said bus bars.

8. The circuit board connecting method according to claim 7, further comprising a step of molding an insulating connecting element around said plurality of board connecting terminals arranged in parallel with one another.

9. A circuit board connecting terminal assembly for electrically connecting a plurality of bus bars, which constitute an electric circuit, to a printed circuit board, on which a control circuit is mounted, said bus bars being separate from any printed circuit board, said terminal assembly comprising:

a plurality of board connecting terminals, each of which has a board connecting portion formed at an end thereof and electrically connected to said printed circuit board by being inserted into a through hole provided in said printed circuit board and also has a pressed-in portion to be press-fitted into a press-fitting hole formed in each of said bus bars by being elastically deformed; and a common insulating connecting element to which said board connecting terminals are fixed, so that said pressed-in portions of said board connecting terminals face to the same side, that said board connecting portions face to the same side, and that said board connecting terminals are arranged in parallel with one another and as to be integral with one another.

10. The circuit board connecting terminal assembly according to claim 9, which is a molding product obtained by molding said insulating connecting element around said plurality of board connecting terminals arranged in parallel with one another.

11. A printed circuit board with board connecting terminals, comprising:

said board terminal assembly according to claim 9; and a printed circuit board having a control circuit mounted thereon and a plurality of through holes provided therein so that each of board connecting portions of board connecting terminals of said terminal assembly is electrically connected to said printed circuit board by being inserted into a corresponding one of said plurality of through holes.

12. The printed circuit board with board connecting terminals according to claim 11, wherein said board connecting portions of said circuit board connecting terminals are inserted into the through holes provided in said printed circuit board to a position at which said connecting portions are placed when said insulating connecting element of said board connecting terminal assembly touches a surface of said printed circuit board.

13. A circuit board connecting structure comprising:

said printed circuit board having board connected terminals according to claim 12; and a plurality of bus bars constituting an electric circuit, wherein a press-fitting hole is provided in each of said plurality of bus bars, and wherein said pressed-in portion of each of said board connecting terminals is electrically connected to a corresponding one of said bus bars by being press-fitted into the press-fitting holes.

14. The circuit board connecting structure according to claim 13, wherein the press-fitting holes of said bus bars are formed by partly bending the press-fitting holes of said bus bars in a direction, in which said pressed-in portions are inserted, and wherein said pressed-in portions are pressure-contacted onto surfaces of said bent parts of said pressed-in portions.

15. A circuit board connecting method for electrically connecting a plurality of bus bars, which constitute an electric circuit, to a printed circuit board, on which a control circuit is mounted, said method comprising the steps of:

manufacturing said board connecting terminal assembly according to claim 9;

inserting a board connecting portion of each of said board connecting terminals of said board connecting terminal assembly into a corresponding one of the through holes to thereby connect said board connecting portion to said printed circuit board and to fix said board connecting terminal assembly to said printed circuit board; and press-fitting each of said pressed-in portions of said board connecting terminals into a corresponding one of the press-fitting holes to thereby electrically connect said pressed-in portions to said bus bars.

16. The circuit board connecting method according to claim 15, further comprising a step of molding an insulating connecting element around said plurality of board connecting terminals arranged in parallel with one another.

* * * * *